United States Patent [19]

Wegener et al.

[11] Patent Number: 4,861,508

[45] Date of Patent: Aug. 29, 1989

[54] MOULDED DETERGENT COMPOSITIONS

[75] Inventors: Ingo Wegener, Duesseldorf; Brigitte Giesen, Duesseldorf-Grafenberg; Alfred Meffert, Monheim; Claus Werner, Neuss; Udo Hennen; Marlene Hormes, both of Krefeld, all of Fed. Rep. of Germany

[73] Assignee: Henkel Kommanditgesellschaft auf Aktien, Duesseldorf, Fed. Rep. of Germany

[21] Appl. No.: 164,157

[22] Filed: Mar. 4, 1988

[30] Foreign Application Priority Data

Mar. 5, 1987 [DE] Fed. Rep. of Germany ..... 3707035

[51] Int. Cl.[4] ..... C11D 1/14; C11D 17/00

[52] U.S. Cl. ..... 252/121; 252/108; 252/134; 252/368; 252/370; 252/557; 252/DIG. 16

[58] Field of Search ..... 252/DIG. 16, 121, 557, 252/108, 134, 367, 368, 369, 370

[56] References Cited

U.S. PATENT DOCUMENTS

| | | | |
|---|---|---|---|
| 2,915,473 | 12/1959 | Stirton et al. | 252/161 |
| 3,503,888 | 3/1970 | Miller et al. | 252/117 |
| 3,523,089 | 9/1970 | Garrett | 252/161 |
| 3,989,647 | 11/1976 | Prince | 252/535 |
| 4,543,204 | 9/1985 | Gervasio | 252/531 |

FOREIGN PATENT DOCUMENTS

| | | |
|---|---|---|
| 2403895 | 8/1974 | Fed. Rep. of Germany . |
| 0954833 | 4/1964 | United Kingdom . |

*Primary Examiner*—Prince E. Willis
*Assistant Examiner*—Kathleen Markowski
*Attorney, Agent, or Firm*—Ernest G. Szoke; Wayne C. Jaeschke; Real J. Grandmaison

[57] ABSTRACT

Improved mouldability and surface smoothness is provided for moulded detergent compositions, for example bar soaps, containing from 30 to 70% by weight of a sodium $C_{12}$–$C_{18}$ alkyl sulfate, from 5 to 25% by weight of a $C_{12}$–$C_{18}$ fatty alcohol, from 5 to 25% by weight palmitic and/or stearic acid, optionally partially saponified, and from 1 to 30% by weight of an α-sulfofatty acid salt corresponding to the following formula

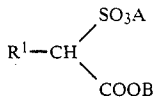

(I)

wherein $R^1$ is a linear $C_9$–$C_{21}$ alkyl group, A is an alkali metal, ammonium or alkanolammonium cation, and B is hydrogen or has one of the meanings of A.

11 Claims, No Drawings

MOULDED DETERGENT COMPOSITIONS

BACKGROUND OF THE INVENTION

1. Field of the Invention

This invention relates to moulded detergent compositions based on fatty alcohol sulfates which show improved mouldability and surface smoothness.

It is known that fatty alcohol sulfates, such as soaps based on fatty acids, may be brought into a suitable shape for transport and application by kneading, milling, extrusion, cutting and barring. It is possible in this way to produce needles, granulates, noodles, bars and handy blocks. However, the poor plasticity of the fatty alcohol sulfates poses considerable problems in their processing to moulded products and it is known that further surfactant components, plasticizers, binders, fillers and other additives are added to the fatty alcohol sulfate to improve its processing and performance properties. Known additives for synthetic bar soaps are reviewed in JAOCS, Vol. 59, No. 10 (October, 1982), pages 442 to 448.

Syndet soap compositions based on fatty alcohol sulfates containing $C_{12}$–$C_{18}$ fatty alcohols or fatty acids or partially hydrolyzed fatty acids as plasticizers and binders have long been known and commercially available.

2. Discussion of Related Art

It is also known that α-sulfofatty acid salts may be used as components of moulded detergent compositions based on synthetic detergents. Great Britain Patent 954,833 describes the addition of dialkali metal salts of $C_{12}$–$C_{18}$ α-sulfofatty acids to detergent bars based on alkali metal acyl isethionates. U.S. Pat. No. 3,523,089 describes the addition of α-sulfofatty acid alkali metal salts to synthetic detergent bars based on α-olefin sulfonates. German Patent Application 24 03 895 describes the use of α-sulfofatty acid ($C_8$–$C_{16}$) alkali metal salts as a surfactant base for mildly acidic syndet toilet soaps. U.S. Pat. No. 2,915,473 describes a combination of from 35 to 45% by weight tallow alcohol sulfate and from 55 to 65% by weight α-sulfotallow fatty acid as a base for detergent bars. Finally, U.S. Pat. No. 3,503,888 describes, α-sulfopalmitic acid sodium salt as a calcium soap dispersant in detergent bars based on coconut fatty acid phenol ester sulfonates and coconut fatty acid soap.

DESCRIPTION OF THE INVENTION

Other than in the operating examples, or where otherwise indicated, all numbers expressing quantities of ingredients or reaction conditions used herein are to be understood as modified in all instances by the term "about".

The present invention is based on the finding that the mouldability and smoothness of moulded detergent compositions based on sodium alkyl sulfate containing fatty alcohols and fatty acids as a plasticizer and binder may be significantly improved by the addition thereto of an α-sulfofatty acid salt in relatively small quantities. At the same time, such detergent compositions provide an improved feel to the skin in use. On the basis of this finding, it was possible to determine the quantitative ratios between the components which provide for a moulded detergent composition that is particularly favorable in regard to ease of production, strength and performance properties.

Accordingly, the present invention relates to moulded detergent compositions containing from 30 to 70% by weight of a $C_{12}$–$C_{18}$ sodium alkyl sulfate, characterized in that they contain from 5 to 25% by weight of a $C_{12}$–$C_{18}$ fatty alcohol, from 5 to 25% by weight of palmitic and/or stearic acid, optionally in partially hydrolyzed form, and from 1 to 30% by weight of an α-sulfofatty acid salt corresponding to the following formula (I)

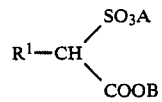

(I)

wherein $R^1$ is a linear C9–$C_{21}$ alkyl group, A is an alkali metal ion, an ammonium ion or a mono-, di- or trialkanolammonium ion containing 2 or 3 carbon atoms in the alkanol group, and B is hydrogen or has one of the afore-described meanings of A, to improve mouldability and performance properties.

The sodium alkyl sulfate may be used in an anhydrous or substantially anhydrous form, for example as a spray-dried powder, as a granulate, in the form of needles or noodles or in recrystallized form. It is possible to use both individual sodium alkyl sulfates, for example sodium lauryl sulfate or sodium cetyl sulfate, and homolog mixtures. It is preferred to use sodium alkyl sulfates based on linear fatty alcohols and fatty alcohol fractions which are obtained by hydrogenation of vegetable or animal fatty acid fractions, for example sodium coconut fatty alcohol ($C_{12}$–$C_{18}$) sulfate or sodium tallow alcohol ($C_6$–$C_{18}$) sulfate.

The $C_{12}$–$C_{18}$ fatty alcohols may also be used as individual alcohols or as homolog mixtures, for example in the composition obtained by hydrogenation of vegetable or animal fatty acid fractions, for example $C_{12}$–$C_{18}$ coconut fatty alcohol or tallow alcohol. Saturated $C_{16}$–$C_{18}$fatty alcohols, for example cetostearyl alcohol fractions, are particularly suitable.

The palmitic acid and stearic acid may be used both in pure form or in admixture. Although saponification is not necessary per se, it may be useful to add a small quantity of an alkali metal hydroxide to prevent decomposition of the alkyl sulfate during mixing of the components at elevated temperature in a kneader. A small proportion of the palmitic and/or stearic acid may be transformed into the soap. However, it is important to ensure that no more than 50% of the fatty acid is saponified.

α-Sulfofatty acid salts corresponding to formula I are known from the literature. The production of α-sulfopalmitic disodium salt and its homologs from lauric, myristic and stearic acid and their properties are described, for example, in J. Am. Oil Chem. Soc., May 1952, pages 198 to 201. Other α-sulfofatty acid salts corresponding to formula I, for example the ammonium and alkanolammonium salts, may be similarly prepared providing the corresponding bases are used for neutralization. Suitable alkanolamines include, for example, mono-, di- and triethanolamine or mono-, di- or triisopropanolamine. Mixed salts, for example the sodium-triethanolammonium mixed salts, may also be similarly prepared by carrying out neutralization with 1 mole of sodium hydroxide and 1 mole of triethanolamine per mole of α-sulfofatty acid. "Acidic" salts of the α-sulfofatty acids may also be produced by neutralization with only 1 mole of the base.

In addition to the afore-mentioned required components, the moulded detergent compositions according to the invention may contain other suitable surfactants, among which the disodium salts of sulfosuccinic acid monoalkyl ($C_8$–$C_{18}$) esters are preferred. They may be present in quantities of up to 35% by weight and are preferably present in quantities of from 5 to 25% by weight. The sulfosuccinic acid monoalkyl esters may be prepared in known manner by reacting maleic acid anhydride with a $C_8$–$C_{18}$ fatty alcohol to form the maleic acid monoester of the fatty alcohol and sulfiting the resulting monoester with sodium sulfite to form the sulfosuccinic ester.

Other known surfactants and auxiliaries may be present in the moulded detergent compositions in quantities of up to 20% by weight. The following are examples of optional surfactants and auxiliaries which are particularly suitable for use in the moulded detergent compositions according to the invention:

(a) anionic surfactants, for example α-olefin sulfonates containing from 15 to 18 carbon atoms, acyl sarcosines, acyl isethionates and acyl taurines each containing from 8 to 18 carbon atoms in the acyl group, alkyl ($C_8$–$C_{18}$) phosphates and acyl cyanamides containing from 8 to 18 carbon atoms in the acyl group;

(b) nonionic surfactants, for example fatty acid mono- and diglycerides, sorbitan fatty acid esters, fatty acid alkanolamides and ethylene oxide adducts with these compounds, also adducts of ethylene oxide and/or propylene oxide with $C_8$–$C_{22}$ fatty alcohols, with $C_{12}$–$C_{18}$ fatty amines, and with alkyl phenols containing from 8 to 15 carbon atoms in the alkyl group. Other suitable nonionic surfactants include sugar fatty acid esters, alkyl glucosides and alkyl oligoglucosides containing from 8 to 18 carbon atoms in the alkyl group and methyl glucoside fatty acid partial esters and also ethylene oxide adducts thereof;

(c) ampholytic surfactants, for example 2-alkyl ($C_8$–$C_{18}$) aminopropionic acid, alkyl ($C_8$–$C_{18}$) aminoacetic acid;

(d) zwitterionic surfactants, such as for example N-alkyl ($C_8$–$C_{18}$) dimethylammonioglycinate, alkyl ($C_8$–$C_{18}$) aminopropyl dimethylammonioglycinate, alkyl ($C_8$–$C_{18}$) 3-carboxymethyl-3-hydroxy-ethylimidazoline;

(e) organic fillers and auxiliaries, such as for example starch, dextrin, carboxymethyl cellulose, sorbitol, mannitol, urea, proteins and protein hydrolyzates, polyethylene glycols, paraffin;

(f) inorganic fillers and auxiliaries, such as for example sodium sulfate, sodium hydrogen phosphate, sodium hydrogen carbonate, layer silicates (for example bentonite, montmorillonite), zeolites (for example zeolite A), waterglass;

(g) complexing agents;

(h) antimicrobial agents, preservatives, dyes;

(i) opacifiers and dulling agents, for example pigments, such as titanium dioxide; and (j) perfumes.

In one particularly preferred embodiment, the detergent compositions moulded in accordance with the invention contain from 40 to 60% by weight of a $C_{10}$–$C_{18}$ sodium alkyl sulfate, from 10 to 20% by weight of cetyl and/or stearyl alcohol, from 10 to 20% by weight of an optionally partially saponified palmitic and/or stearic acid, from 5 to 20% by weight of an α-sulfofatty acid salt corresponding to formula I, and from 0 to 20% by weight of other known surfactants and auxiliaries.

The detergent compositions moulded in accordance with the invention may be produced by any of the methods normally used for such products, the combination of additives according to the invention providing for the formation of a particularly readily mouldable mass which is plastic when hot and solidifies on cooling, the moulded products having a smooth surface. Standard processes for mixing and homogenization, kneading, optionally milling, extrusion, pelletizing, cutting and barring, as described in the above-cited Article in JAOCS, Vol. 59, No. 10 (October, 1982), may be used for the production of the detergent compositions moulded in accordance with the invention.

The following procedure has proved to be particularly effective for the production of handy syndet soap bars. That is, the meltable components, for example the fatty alcohol, the palmitic and/or stearic acid and, optionally, nonionic surfactants or meltable organic fillers and auxiliaries are melted at 60° to 90° C. in a heatable kneader or mixer and mixed, optionally after addition of a small quantity of an alkali metal hydroxide solution. The sodium alkyl sulfate is then added, optionally together with other components which do not melt at 60° to 90° C., and water in a quantity which adjusts the total water content of the batch to around 5 to 15% by weight of water. The batch is then mixed or kneaded at a temperature of from about 40° to 70° C. Further homogenization may be obtained by repeatedly pressing the mass through sieves at 40° to 70° C. and, finally, extruding it at a head temperature of 40° to 70° C. to form a strand which is cut into uniform blocks. Finally, the blocks thus formed may be brought into their final shape in a moulding press. Instead of an extruder, a perforated plate may also be used for extrusion, in which case the detergent compositions according to the invention are obtained after cooling in the form of needles or, where the perforated plate is followed by cutters, in the form of granulates.

The following Examples are intended to illustrate the invention without limiting it in any way.

Examples

| Composition | 1 | 2 | 3 | 4 | 5 |
|---|---|---|---|---|---|
| Cetostearyl alcohol (50:50) | 10 | 10 | 12 | 20 | 15 |
| Palmitic-stearic acid (50:50) | 15 | 15 | 15 | 10 | 10 |
| KOH (33% by weight in $h_2O$) | 1 | 1 | 1 | 0.6 | 0.6 |
| Coconut fatty alcohol ($C_{12}$–$C_{18}$) sulfate, Na salt | 57 | 32 | 53 | 42 | 35 |
| Sulfosuccinic acid monoalkyl ($C_{12}$–$C_{18}$) ester, disodium salt | 5 | 25 | — | 3 | 15 |
| α-Sulfolauric acid, disodium salt | 2 | 7 | — | — | — |
| α-Sulfolauric/myristic acid, disodium salt | — | — | 10 | 15 | 15 |

Examples-continued

| Composition | 1 | 2 | 3 | 4 | 5 |
|---|---|---|---|---|---|
| Hydrotallowalcohol ethoxylate (14 moles ethylene oxide) | 1 | 1 | 2 | — | — |
| Water, to make | 100% | 100% | 100% | 100% | 100% |

Production

The cetostearyl alcohol, palmitic-stearic acid and, optionally, hydrotallowalcohol ethoxylate were melted in a kneader at 70° C. The KOH solution heated to 60° C. was then added, followed by kneading for 30 minutes. The fatty alcohol sulfate, the sulfosuccinic acid ester salt, the α-sulfofatty acid salt and the water were then added. After kneading for about another hour, the water content of a sample was determined. A total water content of 11% by weight was adjusted by addition of more water, followed by kneading for another 30 minutes. After cooling to 45° C., the mass was transferred to a twin-screw extruder, pelletized, forced twice through a 0.25 mm sieve, extruded into a strand at a head temperature of 50° C., cut into blocks and made into the final bar soap in a moulding press. Smooth, solid syndet bar soaps were obtained.

We claim:

1. A moulded detergent composition comprising from about 30 to about 70% by weight of a $C_{12}$–$C_{18}$ sodium alkyl sulfate, from about 5 to about 25% by weight of a $C_{12}$–$C_{18}$ fatty alcohol, from about 5 to about 25% by weight of a fatty acid selected from the group consisting of palmitic acid, stearic acid and mixtures thereof, and from about 1 to about 30% by weight of an α-sulfofatty acid salt corresponding to the following formula (I)

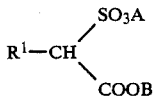

(I)

$R^1$ is a linear C9–$C_{21}$ alkyl group, A is an alkali metal ion, an ammonium ion or a mono-, di- or trialkanolammonium ion containing 2 or 3 carbon atoms in the alkanol group, and B is hydrogen or has one of the meanings of A and from about 5 to about 25% by weight of a sulfosuccinic acid monoalkyl ($C_8$–$C_{18}$) ester disodium salt.

2. A moulded detergent composition as in claim 1 wherein said fatty acid contains no more than about 50% by weight of saponified fatty acid.

3. A moulded detergent composition as in claim 1 containing from about 5 to about 15% by weight of water.

4. A moulded detergent composition as in claim 1 in the shape of a soap bar.

5. A moulded detergent composition comprising: from about 40 to about 60% by weight of a $C_{10}$–$C_{18}$ sodium alkyl sulfate, from about 10 to about 20% by weight of a fatty alcohol selected from the group consisting of cetyl alcohol, stearyl alcohol and mixtures thereof, from about 10 to about 20% by weight of fatty acid selected from the group consisting of palmitic acid, stearic acid and mixtures thereof, from about 5 to about 20% by weight of an α-sulfofatty acid salt corresponding to the following formula (I)

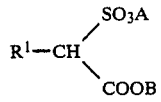

(I)

wherein $R^1$ is a linear C9–$C_{21}$ alkyl group, A is an alkali metal ion, an ammonium ion or a mono-, di- or trialkanolammonium ion containing 2 or 3 carbon atoms in the alkanol group, and B is hydrogen or has one of the meanings of A, and from about 5 to about 25% by weight of a sulfosuccinic acid monoalkyl ($C_8$–$C_{18}$) ester disodium salt and from 0 to about 20% by weight of other surfactants and auxiliaries.

6. A moulded detergent composition as in claim 5 wherein said fatty acid contains no more than about 50% by weight of saponified fatty acid.

7. A moulded detergent composition as in claim 5 containing from about 5 to about 15% by weight of water.

8. A moulded detergent composition as in claim 5 in the shape of a soap bar.

9. The process of preparing a moulded detergent composition having improved mouldability and surface smoothness characteristics and containing from about 30 to about 70% by weight of a $C_{12}$–$C_{18}$ sodium alkyl sulfate, from about 5 to about 25% by weight of a $C_{12}$–$C_{18}$ fatty alcohol, from about 5 to about 25% by weight of a fatty acid selected from the group consisting of palmitic acid, stearic acid and mixtures thereof and from about 1 to about 30% by weight of an α-sulfofatty acid salt corresponding to the following formula (I)

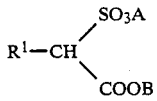

(I)

wherein $R^1$ is a linear C9–$C_{21}$ alkyl group, A is an alkali metal ion, an ammonium ion or a mono-, di- or trialkanolammonium ion containing 2 or 3 carbon atoms in the alkanol group, and B is hydrogen or has one of the meanings of A and from about 5 to about 25% by weight of a sulfosuccinic acid monoalkyl ($C_8$–$C_{18}$) ester disodium salt, said process comprising melting said fatty alcohol and said palmitic and/or stearic acid at a temperature of from about 60° C. to about 90° C. in a kneader or mixer, adding said sodium alkyl sulfate, said α-sulfofatty acid salt and from about 5 to about 15% by weight of water, based on the weight of the detergent composition, mixing the ingredients, extruding the composition to form a strand thereof, cutting the extrudate into blocks, and forming the blocks into their final shape in a moulding press.

10. The process as in claim 9 wherein said fatty acid contains no more than about 50% by weight of saponified fatty acid.

11. The process as in claim 9 including moulding said composition into the shape of a soap bar.

* * * * *